United States Patent [19]

Yamazaki et al.

[11] 4,245,323

[45] Jan. 13, 1981

[54] ELECTRONIC CALCULATOR WITH TIME DISPLAY FUNCTION

[75] Inventors: Masaru Yamazaki; Kunimitsu Fujimoto, both of Tokyo, Japan

[73] Assignee: Copal Co., Ltd., Tokyo, Japan

[21] Appl. No.: 7,016

[22] Filed: Jan. 26, 1979

Related U.S. Application Data

[63] Continuation of Ser. No. 811,953, Jun. 30, 1977, abandoned.

[51] Int. Cl.[3] ..... G04B 19/22

[52] U.S. Cl. ..... 364/705; 364/569; 368/22; 368/10

[58] Field of Search ..... 364/705, 706, 709, 710, 364/569; 58/50 R, 152 R, 4 A, 42.5

[56] References Cited

U.S. PATENT DOCUMENTS

| | | | |
|---|---|---|---|
| 3,186,158 | 6/1965 | Miller | 58/42.5 |
| 3,813,533 | 5/1974 | Cone et al. | 364/705 |
| 3,816,730 | 6/1974 | Yamamoto et al. | 364/705 |
| 3,940,920 | 3/1976 | Nakamura et al. | 58/42.5 |
| 3,955,355 | 5/1976 | Luce | 364/705 |
| 4,035,627 | 7/1977 | Dickinson et al. | 364/706 |
| 4,044,545 | 8/1977 | Shimizu | 58/50 R |

*Primary Examiner*—Errol A. Krass
*Attorney, Agent, or Firm*—Woodcock, Washburn, Kurtz, Mackiewicz & Norris

[57] ABSTRACT

An electronic calculator with a time display function which is operable in either a calculator mode, a clock mode or a world clock mode is disclosed. The calculator includes a calculator section for performing basic arithmetic calculations. An input unit is provided for supplying input data and country codes to the calculator section and a time unit signal generator is provided for supplying a time unit signal to the calculator section. The calculator section includes an arithmetic part for carrying out at least the four basic arithmetic calculations; a memory part for storing the output of the arithmetic part, a control part for controlling the arithmetic part and the memory part, and a common display for displaying the contents of the memory. The memory part further includes a time information register means used for storing a reference time of a predetermined standard country and an arithmetic register means used for carrying out the aforementioned basic arithmetic calculations when the calculator is operating in the calculator mode.

5 Claims, 2 Drawing Figures

ELECTRONIC CALCULATOR WITH TIME DISPLAY FUNCTION

This is a continuation, of application Ser. No. 811,953 filed June 30, 1977 and now abondoned.

BACKGROUND OF THE INVENTION

1. Field of the Invention:

This invention relates to an electronic calculator with different calculation functions such as the four basic arithmetic functions, and a time display function.

2. Description of the Prior Art:

An electronic calculator with time display function has recently been marketed. The electronic calculator includes a calculation part and a clock part arranged separately from each other. The calculation part comprises mainly a display unit, an input unit for generating numeral input signals, arithmetic instruction and the like, an arithmetic unit, a memory circuit cooperating with the arithmetic unit, and a control circuit for operating the arithmetic unit and the memory circuit which functions in accordance with a predetermined program. The clock part comprises mainly a time unit signal generator and a counter for counting the time unit signals. The electronic calculator is changed over to the operating mode of the calculation part or to the operating mode of the clock portion for arithmetic or time display.

Only the standard time of a predetermined country is displayed in the conventional electronic calculator with time display function. When one travels to another country, or one uses a telegram, a telephone or a TELEX (teleprinter exchange) for the other country, it is often desirable to know the present time of the other country. For that purpose, the time difference between the predetermined country and the other country should be calculated.

SUMMARY OF THE INVENTION

An object of the present invention is to provide an electronic calculator with a time display function having a single calculator section, which operates in a calculator mode, a clock mode and in a world clock mode as opposed to electronic calculators with time display functions having separate calculator sections and clock sections known to the prior art.

An object of this invention is to provide an electronic calculator with time display function in which the present time is initially set to a standard time of an appointed one of the countries of the world, and the present time of another country using another standard time is displayed by inputting a country code for the other country, i.e., to provide an electronic calculator which has a "world clock function".

Another object of this invention is to provide an electronic calculator with time display function by which the present time of the selected or desired one of the countries of the world can be displayed, and further by which different calculations such as four basic arithmetic functions can be effected.

In achieving these objects, an electronic calculator having a time display function and capable of operating in either a calculator mode, a clock mode or a world clock mode is provided. The calculator comprises a calculator section for performing basic arithmetic calculations; an input unit for supplying input data and country codes to the calculator section; and a time unit signal generator for supplying a time unit signal to the calculator section. The calculator section further includes an arithmetic part for carrying out arithmetic calculations and a memory part for storing the output of the arithmetic part including a time information register and an arithmetic register, a control part for controlling the arithmetic part and the memory part and a display part for displaying the contents of the memory part.

In accordance with one aspect of this invention, an electronic calculator with time display function includes an a calculator section having arithmetic part for effecting arithmetic calculations with respect to input data; a memory part having an arithmetic register means for carrying out calculations from the arithmetic part; a control part for the arithmetic part and the memory part and a time information register for storing a reference time of an appointed standard country of the world, wherein the arithmetic part, the arithmetic register and the control part are used for calculation, wherein the arithmetic part, at least a part of the arithmetic register means and the time information register means operate under the conrol of the control part the standard time of the appointed standard country of the world, and wherein, the time difference between the appointed standard country of the world and a desired country of the world is compensated with respect to the standard time memorized in the time information register means, using the arithmetic part and the control part when a country code for the desired country is input to the control part, and the present time of the desired country is displayed.

The above and other objects, features and advantages of this invention, will be apparent in the following detailed description of an illustrative embodiment which is to be read in connection with the accompanying drawings.

DESCRIPTION OF THE PREFERRED EMBODIMENTS

One embodiment of this invention which will be applied to an electronic calculator with a world clock function, will be described with reference to FIG. 1 and FIG. 2.

Figure 1:
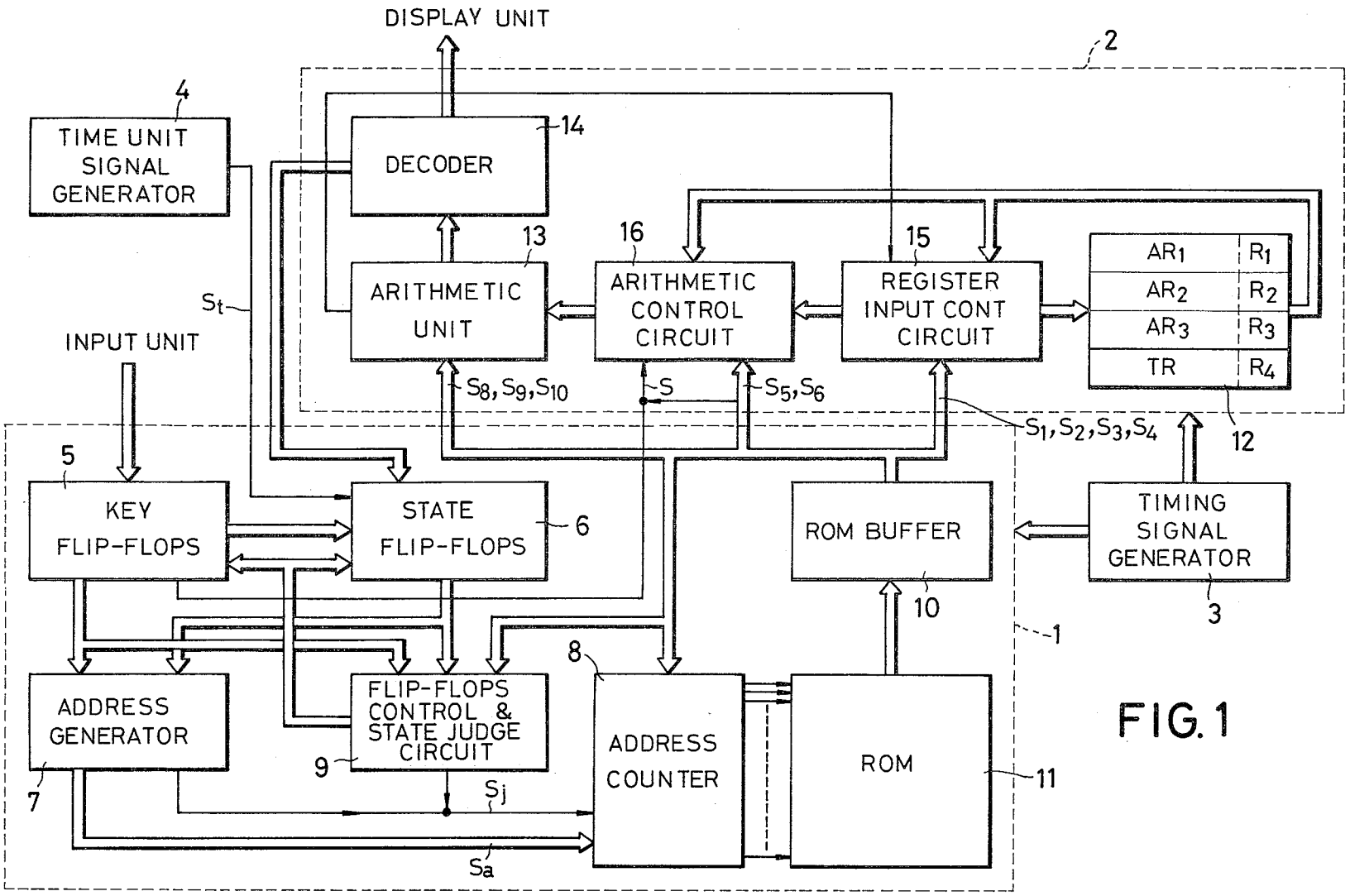
FIG. 1 is a block diagram of an electronic calculator with world clock function according to one embodiment of this invention.

Referring to FIG. 1, an electronic calculator includes a control circuit 1, an arithmetic/memory circuit 2, a timing signal generator 3 and a time unit signal generator 4. The control circuit 1 includes key flip-flops 5, state flip-flops 6, an address generator 7, an address counter 8, a flip-flops control and state judge circuit 9, a ROM(Read Only Memory) buffer 10 and a ROM 11.

The key flip-flops 5 work to supply a key input signal formed by operation of an input unit (keyboard) to the respective parts of the electronic calculator in synchronization with the timing signal of the electronic calculator. The state flop-flops 6 are a memory for storing the state of the arithmetic circuit 2, the previous state of the key flip-flips 5, and a time unit signal St from the time unit signal generator 4. The address generator 7 generates an address signal Sa for instruction to modify a flow of an arithmetic program, in accordance with the states of the key flip-flops 5 and state flip-flops 6. The address signal Sa is supplied to the address counter 8. Addressing signals in a predetermined order are obtained from the address counter 8 on the basis of the address signal Sa, and applied to the ROM 11. The flip-flops control and state judge circuit 9 works to control the key flip-flops 5 and the state flip-flops 6 with control signals obtained from the ROM buffer 10. Further, the flip-flops control and state judge circuit 9 works to judge the states of the key flip-flops 5 and state flip-flops 6, and to supply a jump signal Sj to the address counter 8 for instruction to modify flows of different arithmetic programs obtained from the ROM 11.

All of control signals necessary for the operation of the electronic calculator, such as control signals for change-over of registers in the arithmetic and memory circuit 2 and control signals for controlling the flip-flops 5 and 6, and judging the states of the flip-flops 5 and 6, are formed by the ROM 11 on the basis of the addressing signals obtained from the address counter 8. The control signals from the ROM 11 are applied through the ROM buffer 10 to the respective parts of the electronic calculator, in synchronization with different timing signals obtained from the timing signal generator 3.

The arithmetic and memory circuit 2 includes a register section 12, an arithmetic unit 13, a decoder 14, a register input control circuit 15 and an arithmetic control circuit 16.

Figure 2:
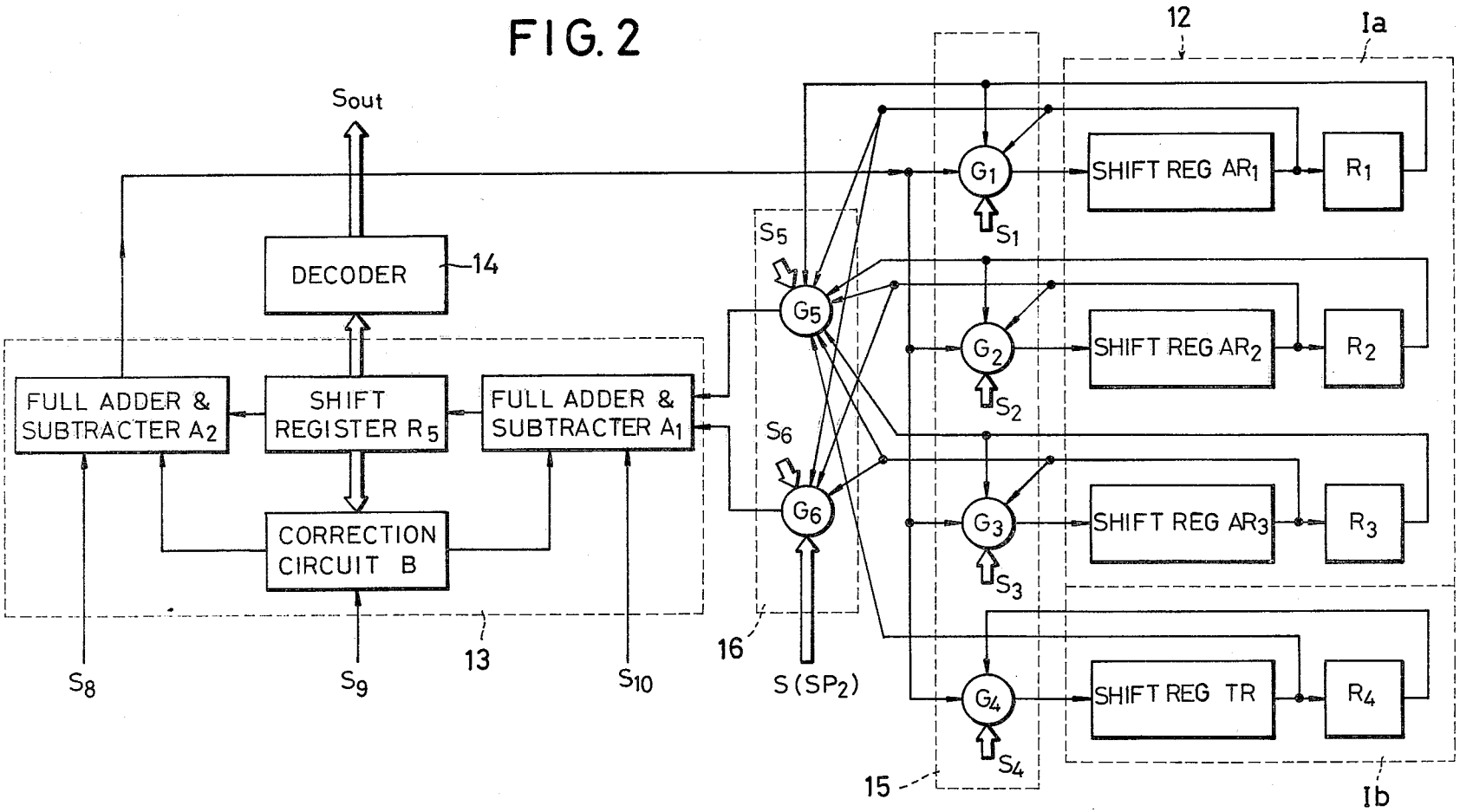
FIG. 2 is a detailed block diagram of an arithmetic unit and memory circuits of the electronic calculator of FIG. 1.

FIG. 2 shows a detailed block diagram of the arithmetic and memory circuit 2. The register section 12 includes 4n-bit shift register $AR_1$, $AR_2$, $AR_3$ and TR (n: positive integer), and 4-bit shift registers $R_1$, $R_2$, $R_3$ and $R_4$. An arithmetic memory circuit I*a* for a normal arithmetic operation is constituted by the shift registers $AR_1$, $AR_2$, $AR_3$, $R_1$, $R_2$ and $R_3$. A time memory circuit $I_b$ for measuring time is constituted by the shift registers TR and $R_4$. The 4n-bit shift register TR includes a memory portion for code numbers for the countries of the world and another memory portion for times of the countries of the world.

The register input control circuit 15 includes gate circuits $G_1$ to $G_4$ which are operated with control signals $S_1$, $S_2$, $S_3$ and $S_4$ supplied from the ROM buffer 10 of the control circuit 1 shown in FIG. 1, to control input signals to the register section 12. The arithmetic control circuit 16 includes gate circuits $G_5$ and $G_6$ which are operated with control signals $S_5$ and $S_6$ supplied from the ROM buffer 10 of the control circuit 1, to control output signals of the register section 12 to be supplied to the arithmetic circuit 13. A numerical input signal S from the input unit (keyboard) is applied through the key flip-flops 5 to the arithmetic control circuit 16. The numerical input signal S is supplied through the arithmetic unit 13 to the register section 12 to be memorized there.

The arithmetic unit 13 includes full adder-subtracters $A_1$ and $A_2$, a 4-bit shift register $R_5$ and a correction circuit B for arithmetic according to binary coded decimal notation. The arithmetic unit 13 is controlled with control signals $S_8$, $S_9$ and $S_{10}$ obtained from the ROM buffer 10, for arithmetic.

The decoder 14 works to judge whether the arithmetic result from the arithmetic unit 13 meets a predetermined condition or not. When the arithmetic result does not meet the predetermined condition, the decoder 14 supplys a signal Sout to the state flip-flops 6 for instruction to modify the flow of the arithmetic program in order to correct the arithmetic result. The decoder 14 further works to supply a display data signal to a display unit (not shown).

The time unit signal ST for measuring time is generated from the time unit signal generator 4 with reference to the frequency of the commercial supply or crystal oscillator. Different timing signals necessary for the respective parts of the calculator are obtained from the timing signal generator 3.

When the electronic calculator with a world clock function shown in FIG. 1 is used for normal arithmetic, the numeral input signal S from the input unit is supplied through the key flip-flops 5 to the gate circuit $G_6$ of the arithmetic control circuit 16, and supplied through the arithmetic unit 13 to the arithmetic memory circuit I*a* of the register section 12 to be stored there. The action of the register section 12 is controlled with the control signals $S_1$ to $S_4$ supplied to the register input control circuit 15, the control signals $S_5$ and $S_6$ supplied to the arithmetic control circuit 16, and the control signals $S_8$ to $S_{10}$ supplied to the arithmetic unit 13, from the control circuit 1.

The address signal Sa is generated from the address generator 7 in response to the states of the key flip-flops 5 and state flip-flops 6, and is applied to the address counter 8. The addressing signals in the predetermined order obtained from the address counter 8 are supplied to the ROM 11. Thus, the control signals $S_1$ to $S_6$ and $S_8$ to $S_{10}$ as the predetermined signals are obtained from the ROM 11, and applied through the ROM buffer 10 to the arithmetic and memory circuit 2 control the above described action of the register section 12.

Next, a function key for one of the basic arithmetic functions, i.e., plus (+), minus (−), multiplication (×), division (÷), equal (=), etc is actuated in the input unit. The states of the key flip-flops 5 and state flip-flops 6 are judged by the flip-flops control and state judge circuit 9. The predetermined jump signal Sj is supplied from the flip-flops control and state judge circuit 9 to the address counter 8. The addressing signals for modifying the flow of the arithmetic program are obtained from the address counter 8 with the supply of the jump signal Sj. The control signals $S_1$ to $S_6$ and $S_8$ to $S_{10}$ for arithmetic are read out from the ROM 11 in accordance with the addressing signals of the address counter 8, and supplied through the ROM buffer 10 to the arithmetic and memory circuit 2 to control the gate circuits $G_1$ to $G_6$ and the arithmetic unit 13. Signals are delivered and received between the arithmetic unit 13 and the arithmetic memory circuit Ia in accordance with the predetermined program for desired arithmetic.

Next, the clock mode of the electronic calculator of FIG. 1 will be described.

The time unit signal St is always applied to the control circuit 1 from the time unit signal generator 4 and a numerical input signal equivalent to that generated when the "1" key is depressed on the keyboard of the input unit is formed in the control circuit 1. The numerical input signal "1" is continuously added to the shift register TR of the time memory circuit Ib. Accordingly, the present time of the appointed country is always stored in the time memory circuit Ib.

The arithmetic unit 13 is used for addition of three numerical input signals "1". The output of the arithmetic unit 13 is supplied to the decoder 14, as the addition result. When the addition result amounts to sixty, the judging signal Sout is supplied from the decoder 14 to the control circuit 1. The carry for second or minute is generated with the control signals obtained from the control circuit 1, according to a logistic system.

The control circuit 1 may be so designed that either the arithmetic operation for calculation or the time measuring operation for clock will be preferentially effected in the electronic calculator of FIG. 1, when the time unit signal St is applied to the control circuit 1 during the normal arithmetic operation. According to this embodiment, the control circuit 1 is so designed that the time measuring operation is effected after the arithmetic operation for calculation is completed. In the embodiment, even when the calculator is not turned on for the normal calculation, electric power is supplied to the control circuit 1, the timing signal generator 3, the time unit signal generator 4 and the time memory circuit Ib, and the calculator functions as a clock.

Next, the world clock mode of the electronic calculator of FIG. 1 will be described. As above described, the code number for the appointed country and the present time of the appointed country are stored in the shift register TR of the time memory circuit Ib.

In order to code the countries of the world, the earth is longitudinally and equally divided into twenty four parts at the intervals of 15°. Code numbers in order are given to the countries, corresponding to the longitudes to which the countries belong. The difference between two code numbers for two countries represents the time difference between the two countries. For example, when a code number "0" is given to Greenwich of England, a code number "9" is correspondingly given to Tokyo of Japan. The difference between the code numbers "0" and "9" represents the time difference (nine hours).

When the time of the clock is initially set in the electric calculator of FIG. 1, a time set switch (not shown) arranged in an operation part of the electric calculator is turned on. Signals for a code number $P_1$ for an appointed country and the present time $T_1$ of the appointed country are supplied from the input unit to the control circuit 1. The code number $P_1$ and the present time $T_1$ are memorized in the predetermined memory portions of the shift register TR of the time memory circuit $I_b$. As above mentioned, the numerical input signals "1" are added to the time memory circuit Ib with the time unit signal St from the time unit signal generator 4. The memory content of the time memory circuit Ib is displayed in the diaplay unit which is used also for the display of the calculation result. The code number for the appointed country and the present time of the appointed country are displayed in the display unit, such as "1-9:00:01". The electronic calculator may be so designed that the code number for the appointed country and the present time of the appointed country are displayed in the display unit with the switching action of a switch interconnected with a cover for a display portion of the display unit, whenever the cover is opened.

When the time of the appointed country will be changed to the time of another country, a world clock button (not shown) arranged in the operation part of the electronic calculator is depressed, and a signal for a code number $P_2$ for the other country is supplied to the control circuit 1 from the input unit. In accordance with the predetermined program memorized in the control circuit 1, the arithmetic memory circuit Ia, the time memory circuit Ib, the arithmetic unit 13 and the gate circuits $G_1$ to $G_6$ are controlled as follows. The signal for the code number $P_2$ is supplied to the key flip-flops 5 of the control circuit 1. A numerical input signal $SP_2$ is obtained from the key flip-flops 5, and applied to the gate circuit $G_6$. As above described, the state flip-flops 6, the address generator 7, the address counter 8 and the flip-flops control and state judge circuit 9 are operated with the output of the key flip-flops 5. As the result, the control signals $S_1$ to $S_6$ and $S_8$ to $S_{10}$ for the predetermined program are read out from the ROM 11.

The gate circuit $G_6$ is controlled with the control signal $S_6$ to supply the numerical input signal $SP_2$ for the desired country to the arithmetic unit 13. The numerical input signal $SP_2$ is memorized in the predetermined portion of the arithmetic memory circuit Ia, for example, the predetermined portion of the shift register $AR_1$. The memory content $P_1$ of the code number memory portion of the time memory circuit Ib is transmitted to the arithmetic unit 13 through the gate circuit $G_5$ controlled with the control signal $S_5$ in synchronization with the numerical input signal $SP_2$. In the arithmetic unit 13, subtraction is effected between the code number $P_2$ for the desired country and the code number $P_1$ for the appointed country, obtained from the time memory circuit Ib. Thus the time difference D is calculated. The calculation result D from the arithmetic unit 13 is memorized in a predetermined portion of the arithmetic memory circuit Ia, for example, a predetermined portion of the shift register $AR_1$. Further, in accordance with the program based on the control signals $S_1$ to $S_6$ and $S_8$ to $S_{10}$, the time difference D memorized in the arithmetic memory circuit Ia and the memory content $T_1$ of the time memory portion of the time memory circuit Ib are transmitted to the arithmetic unit 13. The time difference D is added to the memory content $T_1$. The addition result $T_2$ is memorized in a predetermined portion of the arithmetic memory circuit Ia, for example, in a predetermined portion of the shift register $AR_2$. The code number "0" and memory content $T_2$ memorized in the shift register $AR_2$ and the code number $P_2$ for the desired country memorized in the shift register $AR_1$ are transmitted to the arithmetic unit 13. The code numbers "0" and "$P_2$" are added to each other in the arithmetic unit 13. The addition result is again memorized in the shift register $AR_1$ of the arithmetic memory circuit Ia.

A change-over switch for time display according to a 12-hours counting system or to a 24-hours counting system is arranged in the operation part of the electronic calculator. The decoder 14 judges whether the arithmetic result of the arithmetic unit 13 meets the condition of the time display according to the 12-hours counting system of the 24-hours counting system, or not. When the memory content $T_2$ memorized in the time memory portion of the arithmetic memory circuit Ia meets the above-mentioned condition, it is decoded by the decoder 14 and displayed in the display unit. And the content $T_2$ is memorized in the arithmetic memory circuit Ia. Thus, a series of time display operations is finished. However, when the memory content $T_2$ memorized inthe time memory portion of the arithmetic memory circuit Ia does not meet the above-mentioned condition, the signal Sout is generated from the decoder 14, and supplied to the control circuit 1 to change the program flow.

With the input of the signal Sout to the control circuit 1, a numerical input signal equivalent to that generated when the integer "12" or "24" is depressed on the keyboard of the input unit is supplied to the gate circuit $G_6$ from the ROM buffer 10. In the arithmetic unit 13, subtraction or addition is effected between the time memory content $T_2$ memorized in the arithmetic memory circuit Ia and the numerical input signal "12" and "24" to correct the time memory content $T_2$ for time display according to the 12-hours counting system or 24-hours counting system. The result of the subtraction or addition is judged by the decoder 14. Since the result now meets the condition, it is decoded by the decoder and displayed in the display unit. And the result is memorized in the arithmetic memory circuit Ia. Thus, a series of time display operations is finished.

As above described, every time when the time unit signal St is applied to the control circuit 1, the numerical input signal "1" is added to the shift register $AR_1$, and the present time of the desired country is displayed in the display unit. Concurrently, the numerical input signal "1" is added also to the shift register TR of the time memory circuit Ib. The present time of the appointed or standard country is always exactly memorized in the time memory circuit Ib.

While there has been described preferred embodiment of the invention, obviously further modifications and variations are possible in light of the above teachings. It is therefore to be understood that within the scope of the appended claims, the invention may be practised otherwise than as specifically described.

What is claimed is:

1. In an electronic calculator of the type having a time display function, said calculator being operable in either a calculator mode, a clock mode or a world clock mode, said calculator having:

(a) a calculator section for performing arithmetic calculations, said calculator section including an arithmetic circuit, a memory circuit having arithmetic register means, and a control circuit for controlling said arithmetic circuit and said memory circuit;

(b) an input unit for supplying input data and country codes to said calculator section, said country codes comprising information representing the time differences between a standard country and desired countries; and (c) a time unit signal generator for supplying a time unit signal to said calculator section, said arithmetic circuit, memory circuit and input unit being coupled through said control circuit to form said calculator, the improvement comprising:

(i) said memory circuit including a time information register means for storing a reference time of an appointed country and country code thereof;

(ii) a clock circuit, comprising said time information register means, arithmetic circuit and control circuit which receives the time unit signal from said time unit signal generator, time increment accumulation being carried out under the control of said control circuit in response to said time unit signal such that the reference time data in said time information register is fed to said arithmetic circuit for adding a unit time thereto to keep said reference time of said appointed country;

(iii) said control circuit including a state holding circuit for holding the time unit signal, said time increment accumulation being carried out in response to the output of said state holding circuit, said accumulation being carried out in said arithmetic circuit in a time-shared fashion with respect to other arithmetic calculations carried out in said arithmetic circuit; and (iv) time difference compensating means comprising said arithmetic circuit, arithmetic register means and control circuit which receives a country code of a desired country from said input unit, time difference compensation with respect to the reference time kept in said time information register means being carried out under the control of said control circuit such that the country code in the time information register and the input country code are fed to said arithmetic circuit for time difference calculation between the appointed country and the desired country, the time difference data is stored in said arithmetic register means and the stored time difference data and the reference time data in the time information register means are fed to the arithmetic circuit for time difference compensation to obtain a real time of said desired country.

2. An electronic calculator according to claim 1 in which said reference time and country code of said appointed country is input to said calculator section to be initially stored in said time information register means.

3. An electronic calculator according to claim 1 in which said country code stored in a part of said time information register means is displayed on display means.

4. An electronic calculator according to claim 1 in which said control circuit includes at least one ROM, said arithmetic calculations, said time increment accumulation and said time difference calculation and time difference compensation being carried out on the basis of programs prestored in said ROM, said programs being read out from the ROM in response to said input data, said time unit signal and said country code, whereby said arithmetic circuit and memory circuit are controlled by the output of the ROM so as to operate in each of said modes.

5. An electronic calculator according to claim 1 which said arithmetic circuit includes an arithmetic unit and a discriminating circuit for determining the condition of the input of said arithmetic unit, the output of said discriminating circuit being fed to the control circuit, and in which the control circuit controls the arithmetic circuit and the memory circuit in response to said output of the discriminating circuit to perform the arithmetic calculations in said calculator mode and said accumulation operation in said clock mode and said world clock mode.

* * * * *

UNITED STATES PATENT AND TRADEMARK OFFICE

CERTIFICATE OF CORRECTION

PATENT NO. : 4,245,323

DATED : January 13, 1981

INVENTOR(S) : Masaru Yamazaki and Kunimitsu Fujimoto

It is certified that error appears in the above-identified patent and that said Letters Patent are hereby corrected as shown below:

Column 2, line 22, after "part" insert --to provide--.

Column 4, line 63, delete "three" and insert --these--.

Column 6, line 51, delete "of" and insert --or--.

Signed and Sealed this

*Twenty-first* Day of *April 1981*

[SEAL]

*Attest:*

RENE D. TEGTMEYER

*Attesting Officer* *Acting Commissioner of Patents and Trademarks*